United States Patent [19]

Yamamoto et al.

[11] Patent Number: 4,813,813

[45] Date of Patent: Mar. 21, 1989

[54] METHOD FOR CONSTRUCTING A TUNNEL

[75] Inventors: Minoru Yamamoto, 1-15-2, Tamagawa Gakuen, Machida-shi; Yoshiharu Kiritani, Urawa, both of Japan

[73] Assignees: Minoru Yamamoto, Tokyo; Sato Kogyo Kabushuki Kaisha, Toyama, both of Japan

[21] Appl. No.: 16,712

[22] Filed: Feb. 19, 1987

[30] Foreign Application Priority Data

Jul. 8, 1986 [JP] Japan ..... 61-158675

[51] Int. Cl.[4] ..... E21D 9/06; E21D 11/00

[52] U.S. Cl. ..... 405/146; 405/150; 425/59; 52/742

[58] Field of Search ..... 405/146, 141, 147, 150; 249/11, 12; 425/59; 264/32; 52/245, 248, 249, 224, 319, 340, 742, 743

[56] References Cited

U.S. PATENT DOCUMENTS

| | | | |
|---|---|---|---|
| 3,197,964 | 8/1965 | Fehlmann et al. | 52/742 |
| 3,550,382 | 12/1970 | Khodosh et al. | 405/146 X |
| 3,990,200 | 11/1976 | Kawasaki et al. | 52/742 X |
| 4,145,861 | 3/1979 | Yarnick | 52/742 |
| 4,645,378 | 2/1987 | Hentschel | 405/146 |

FOREIGN PATENT DOCUMENTS

| | | | |
|---|---|---|---|
| 774835 | 1/1968 | Canada | 405/146 |
| 1252227 | 10/1967 | Fed. Rep. of Germany | 405/146 |
| 2913091 | 10/1980 | Fed. Rep. of Germany | 405/146 |

*Primary Examiner*—Randolph A. Reese
*Assistant Examiner*—John A. Ricci
*Attorney, Agent, or Firm*—Wenderoth, Lind & Ponack

[57] ABSTRACT

The known method for constructing a tunnel of the type in which a shield tunnelling machine is shoved by means of a concrete lining jack and a shield jack equipped on the shield tunnelling machine with reaction forces received by concrete for lining placed in a space delimited by an inner form assembled within a tunnel bore successively dug by the shield tunnelling machine, a shield tail and an already placed concrete lining, as well as by the inner form, is improved in order to construct a main tunnel body as a reinforced concrete structure. The improvements include in that a reinforcing steel cage is mounted to a combined spreader and end form of the concrete lining jack via metal mounts, the placed concrete for lining is compressed while the reinforcing steel cage is moved, and thereby the reinforcing steel cage is disposed at a predetermined position within the concrete for lining by adjusting the stroke of the concrete lining jack.

5 Claims, 10 Drawing Sheets

METHOD FOR CONSTRUCTING A TUNNEL

BACKGROUND OF THE INVENTION

The present invention relates to improvements in a method for constructing a tunnel.

The inventor of this invention proposed, in Japanese Patent Publication No. 54-33656, a method for constructing a tunnel consisting of the steps of assembling an inner form within a tunnel bore that has been successively dug by means of a shield tunnelling machine, placing concrete in a space delimited by the form, a shield tail and a front surface of an already placed concrete lining, and thereafter shoving the shield tunnelling machine by means of a concrete lining jack and a shield jack equipped on the shield tunnelling machine with shoving reaction forces received by the placed concrete and the inner form.

In soft ground to which a shield tunnelling method is applied for constructing a tunnel, it is necessary to employ a reinforced concrete structure to assure safety of the tunnel body structure. Accordingly, upon practicing the above-mentioned constructing method in the prior art, it is necessary to set a reinforcing steel cage within the shield tail of the shield tunnelling machine and to dispose it at a predetermined position.

However, in the shield tail section, working space is very narrow, so the work for assembling the reinforcing steel cage becomes complex, and moreover it is difficult to dispose the set reinforcing steel cage at a predetermined position. Furthermore, upon compressing the placed concrete, there is a fear that the reinforcing steel cage may be moved or deformed. Therefore, it becomes impossible to realize the function of a desired reinforced concrete structure.

SUMMARY OF THE INVENTION

It is therefore one object of the present invention to provide an improved method for constructing a tunnel in which a main tunnel body can be constructed easily and correctly as a reinforced concrete structure through a shield tunnelling method of a field-placed concrete lining type.

According to one feature of the present invention, there is provided a method for constructing a tunnel, in which a reinforcing steel cage is mounted to a combined spreader and end form of a concrete lining jack via metal mounts, placed concrete for lining is compressed while the reinforcing steel cage is moved, and thereby the reinforcing steel cage is disposed at a predetermined position within the concrete for lining.

Upon practicing the present invention as featured above, a spreader of a concrete lining jack equipped to a shield tunnelling machine is commonly used as an end form of concrete lining, a preliminarily assembled reinforcing steel cage is mounted to the combined spreader and end form via mount metals, and by extending the concrete lining jack the reinforcing steel cage is moved to the side of concrete for lining which has been placed in the spaced delimited by an inner form assembled within a tunnel bore that has been successively dug by means of a shield tunnelling machine, a shield tail and an already placed concrete lining, the same concrete is compressed by the combined spreader and end form, and the reinforcing steel cage is disposed at a predetermined position within the concrete for lining by adjusting the stroke of the concrete lining jack, whereby a main tunnel body can be constructed as a reinforced concrete structure through a shield tunnelling method of field-placed concrete lining type.

The above-mentioned and other objects, features and advantages of the present invention will become more apparent by reference to the following description of preferred embodiments of the invention taken in conjunction with the accompanying drawings.

DETAILED DESCRIPTION OF THE PREFERRED EMBODIMENTS

Now description will be made of the illustrated embodiments of the present invention.

Figure 1:
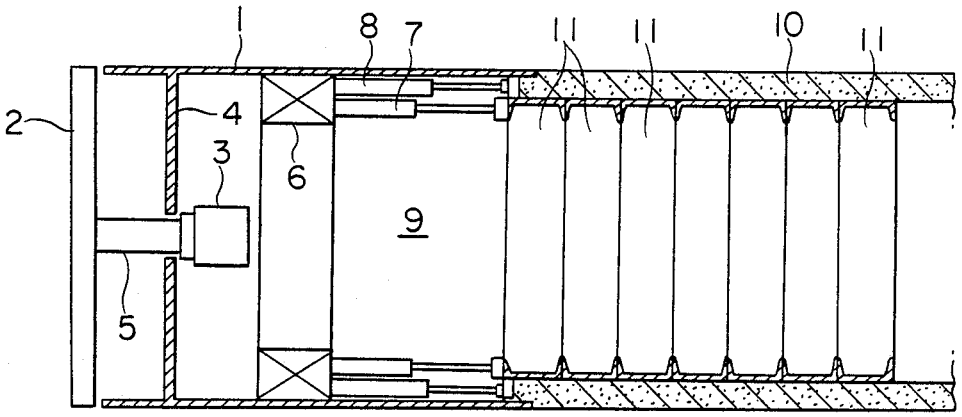
FIGS. 1 through 5 are longitudinal cross-section side views showing successive steps in a method for constructing a tunnel according to one preferred embodiment of the present invention.

In FIG. 1, reference numeral (1) designates a shield shell in a shield tunnelling machine, numeral (2) designates a cutter, numeral (3) designates a motor for driving the cutter (2), numeral (4) designates a bulkhead, numeral (5) designates a cutter chamber formed between the bulkhead (4) and the cutter (2), numeral (6) designates a ring girder, numerals (7) and (8) respectively designate a shield jack and a concrete lining jack mounted to the ring girder (6), numeral (9) designates a shield tail section, and numeral (10) designates a concrete lining that was placed between a form assembled within a tunnel bore successively dug by the shield tunnelling machine (1) and the ground. FIG. 1 shows the state where shoving of the shield tunnelling machine has been completed by means of the shield jack (7) and the concrete lining jack (8) with the shoving reaction forces received by an inner form (11) and the concrete lining (10).

Figure 2:
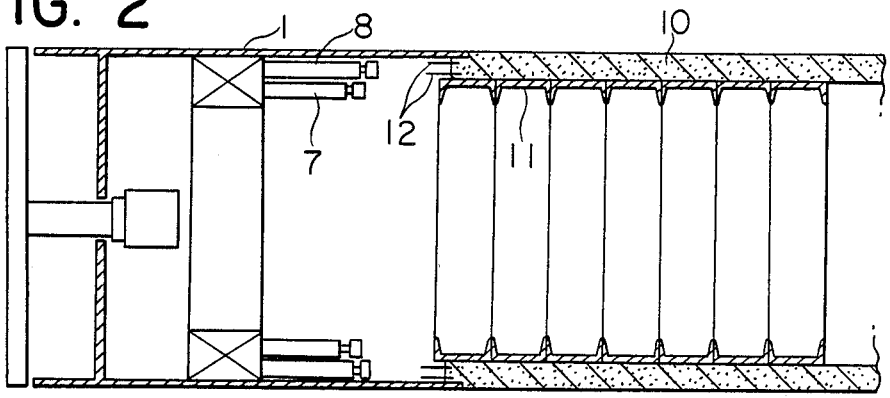
Figure 3:
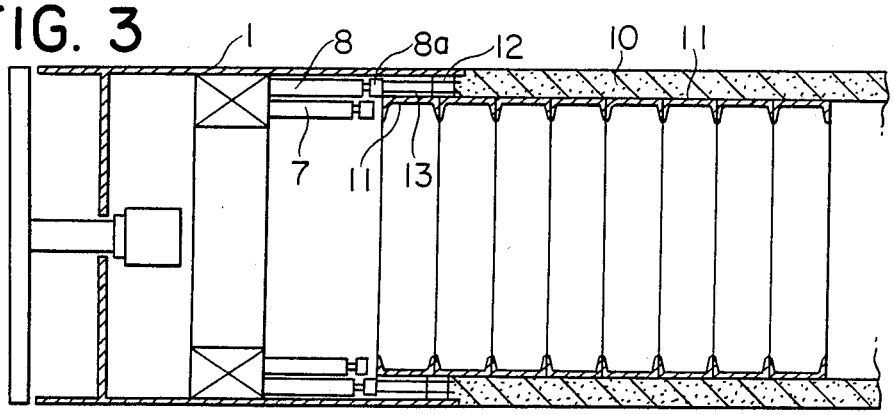
Figure 4:
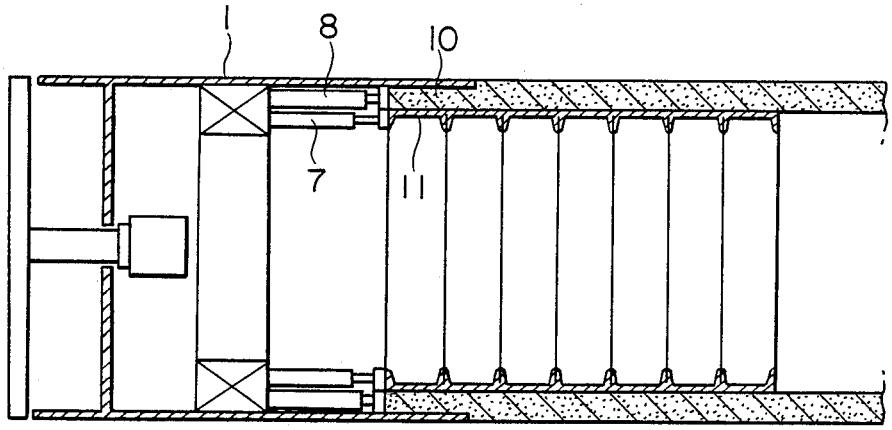

FIGS. 2 to 4 show the states where the respective jacks (7) and (8) are retracted, and in this state, hook bolts (12) disposed as penetrating through a combined spreader and end form (8a) of the concrete lining jack (8) are left on the side of the concrete lining (10).

Figure 5:
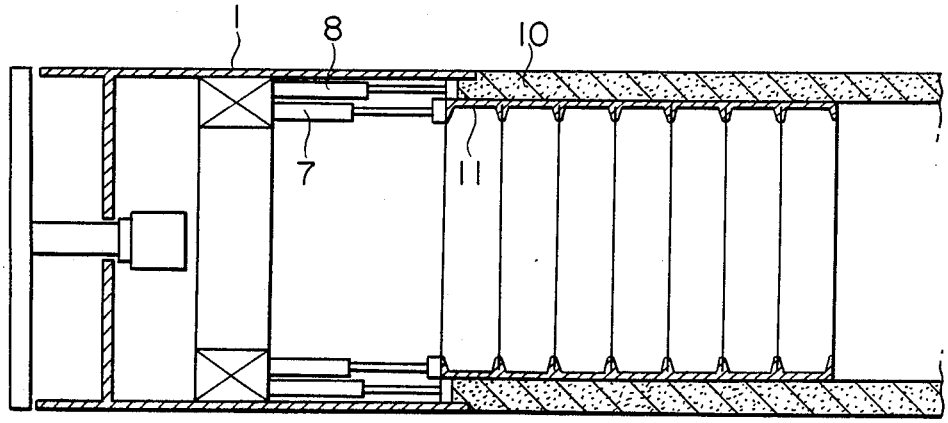

Subsequently, as shown in FIG. 3, a reinforcing steel cage (13) is mounted to the combined spreader and end form (8a) via the hook bolts (12), then the reinforcing steel cage (13) is moved up to a predetermined position by extending the concrete lining jack (8), and the inner form (11) is assembled inside of the reinforcing steel cage (13) FIGS. 4 and 5 show the states where the concrete is placed in the tail section (10), and the shield tunnelling machine is shoved by jacks (7) and (8) respectively.

Figure 8:
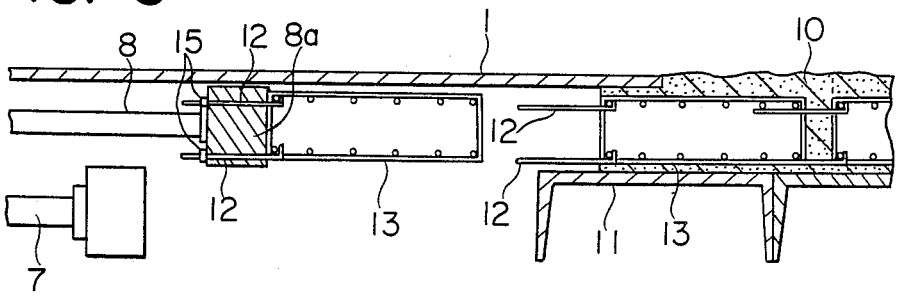
Figure 9:
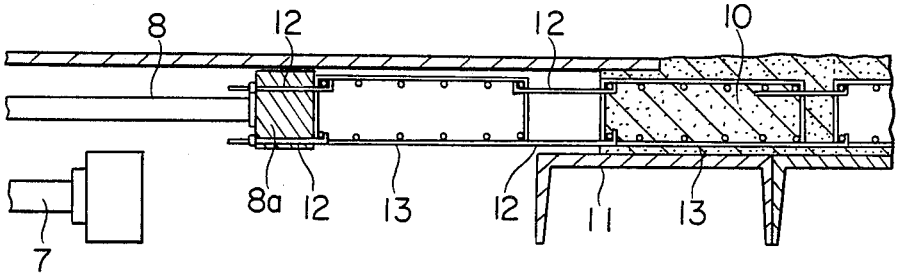
Figure 10:
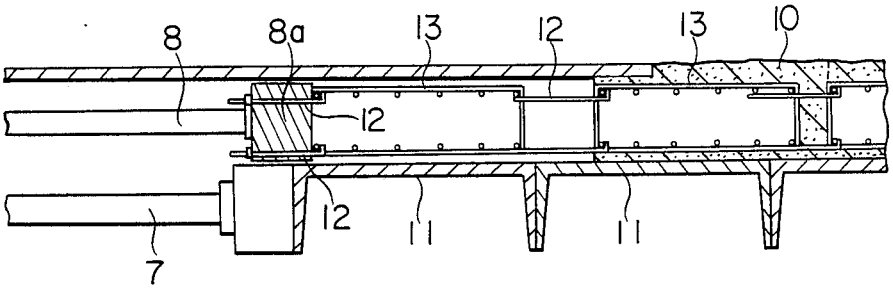

FIGS. 6 to 10 show the steps of mounting and moving the above-mentioned reinforcing steel cage (13), in which hook bolts (12) are inserted into through-holes (14) in the combined spreader and end form (8*a*) (See FIG. 7), the nuts (15) are threadedly engaged with the hook bolts (12) and fastened fixedly to secure the hook bolts (12) to the combined spreader and end form (8*a*), and the reinforcing steel cage (13) is engaged with hook portions at the tip ends of the hook bolts (12) (See FIG. 8). Subsequently the reinforcing steel cage (13) is moved by extending the above-described concrete lining jack (8), then the tip end of the moved reinforcing steel cage (13) is engaged with hook bolts (12) projecting from a reinforcing steel cage (13) disposed in the already placed concrete lining (See FIG. 9), and thereafter an inner form (11) is assembled (See FIG. 10).

Figure 11:
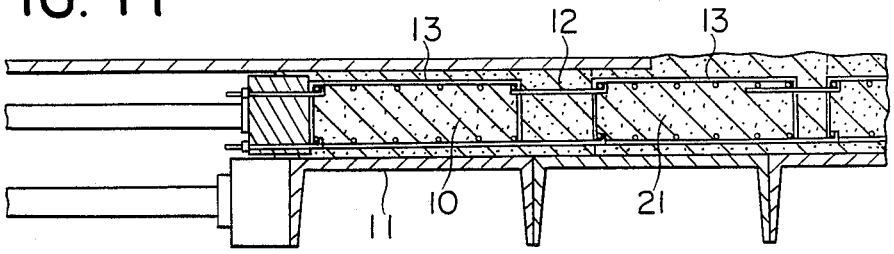

Next, as shown in FIGS. 4 and 11, a concrete lining (10) is placed around the outer circumference of the newly assembled inner form (11).

Figure 12:
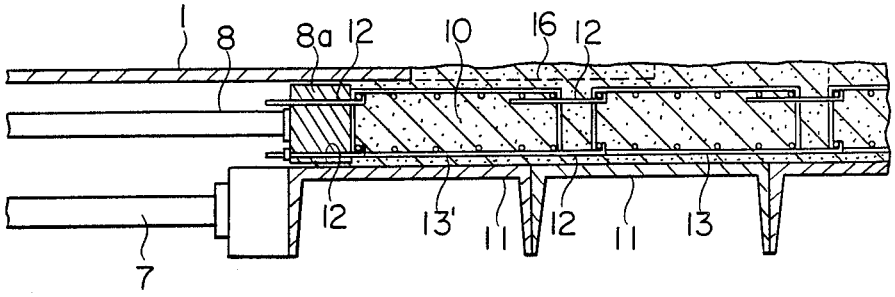

Subsequently, as shown in FIGS. 5 and 12, the shield jack (7) and the concrete lining jack (8) are extended with the reaction forces received respectively by the inner form (11) and the placed concrete lining (10), and thereby the shield tunnelling machine is shoved until the state shown in FIG. 1 is again established.

At this time, a cavity portion (16) formed by the advance of the shield shell (1) is filled with concrete for lining (10), and the reinforcing steel cage moves rightwards as shown at (13') in FIG. 12 simultaneously with extension of the concrete lining jack (8). During this movement, the reinforcing steel cage (13') would not be displaced in the lateral position because it moves as guided by the hook bolts (12). In addition, as the reinforcing steel cage (13') is fixedly secured to the combined spreader and end form (8*a*) via the hook bolts (12), it would not be subjected to a thrust of the concrete lining jack (8), and hence stress or deformation would not be generated in the reinforcing steel cage (13').

Figure 6:
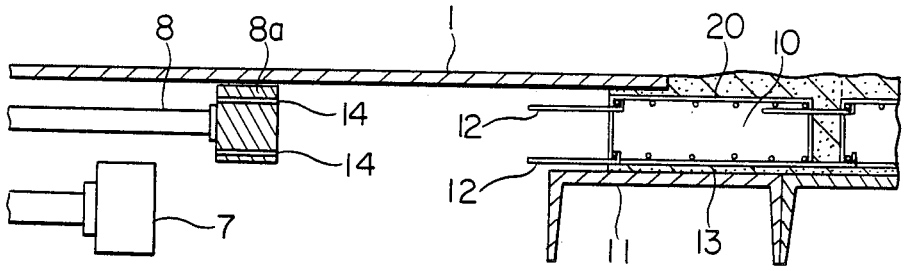
FIGS. 6 through 12 are detailed partial views showing the same respective steps.
Figure 7:
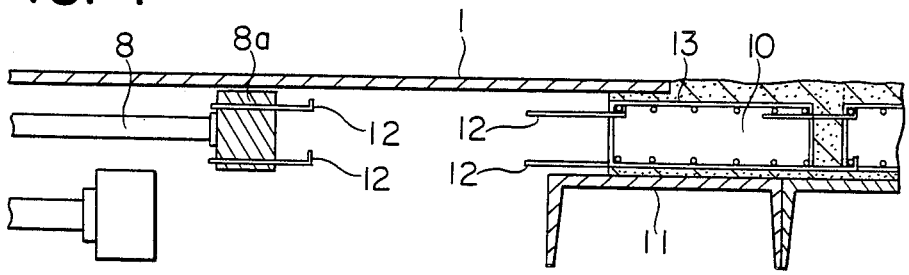

When the shoving of the shield tunnelling machine has been completed in the above-described manner, the nuts (15) are removed and the combined spreader and end form (8*a*) is retracted, the hook bolts (12) would remain on the side of the concrete lining (10) and the state shown in FIG. 6 is realized.

Thereafter, similar steps to the above-described ones are repeated and the reinforcing steel cage is buried in the concrete lining.

Figure 13:
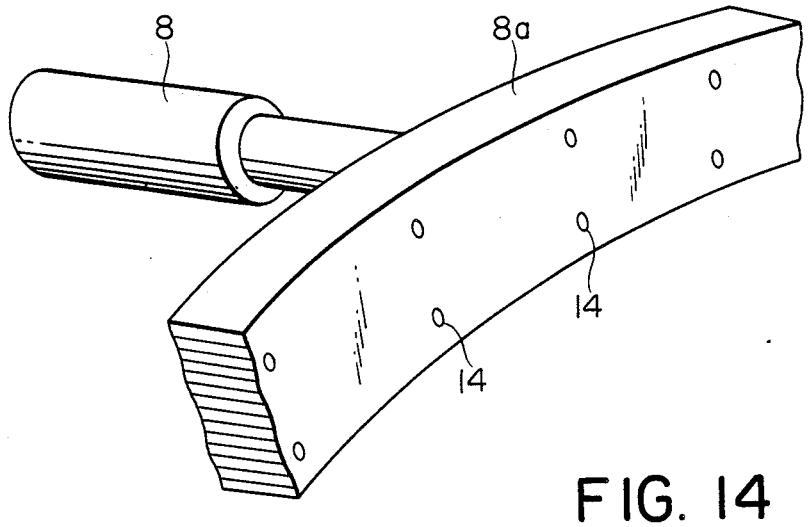
FIGS. 13 to 16 are partial perspective views showing the steps of mounting and moving a reinforcing steel cage.
Figure 14:
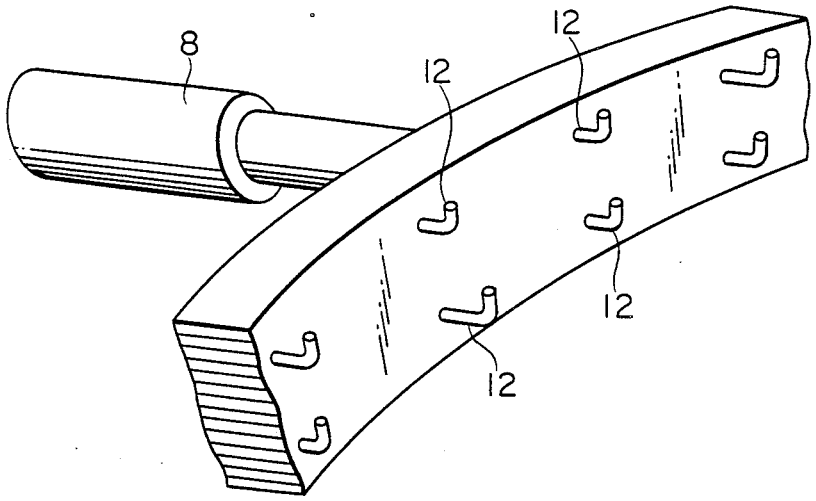
Figure 15:
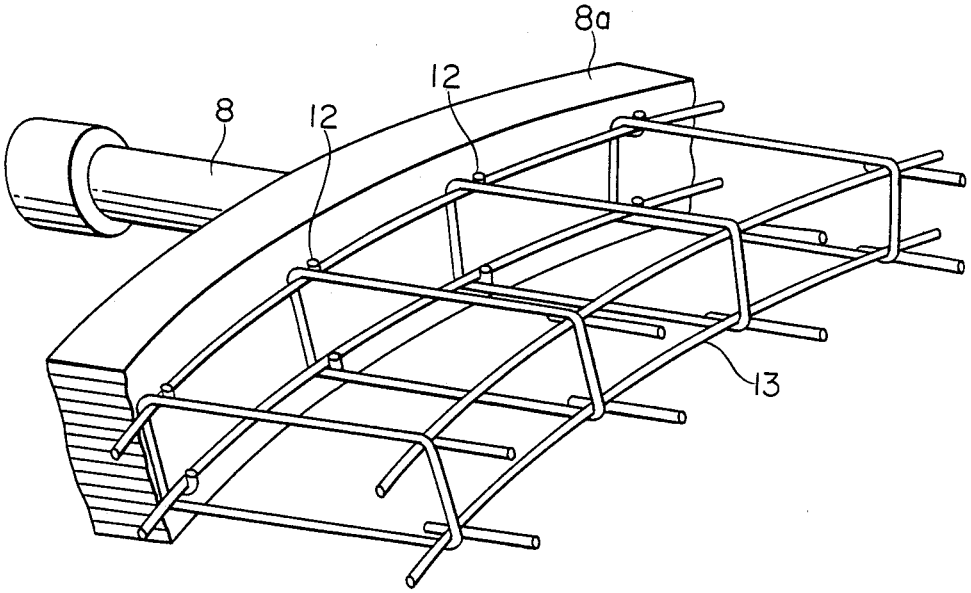
Figure 16:
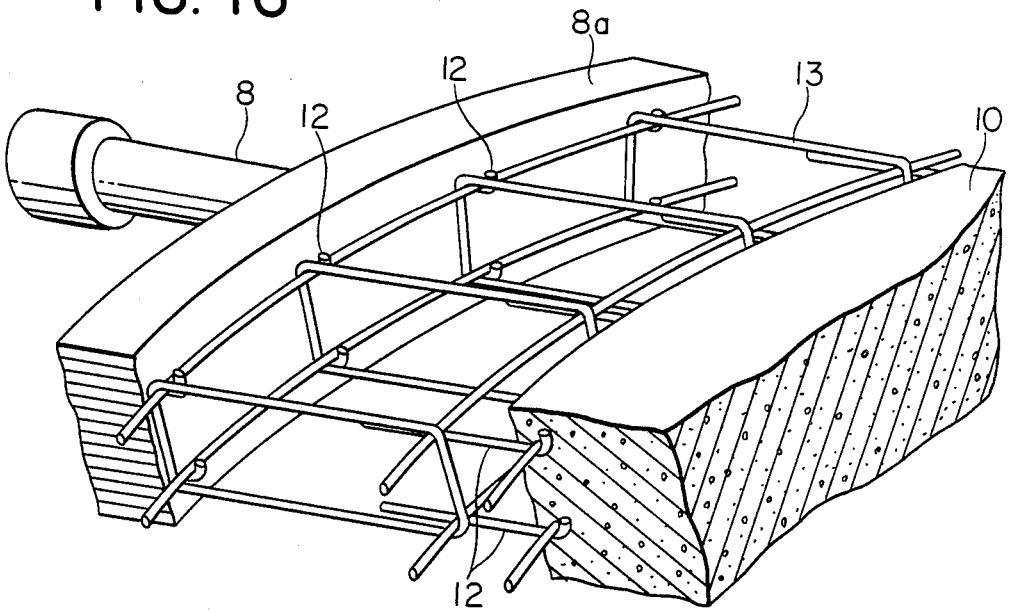

FIGS. 13 to 16 show details of the steps of mounting a reinforcing steel cage (13) to the above-described combined spreader and end form (8*a*) and shoving the same. In the combined spreader and end form (8*a*) formed in an arcuated shape and having a large number of through-holes (14) as shown in FIG. 13, hook bolts (12) are inserted into the respective through-holes (14) (See FIG. 14), then a reinforcing steel cage (13) is engaged with the hook bolts (12) as shown in FIG. 15, and as shown in FIG. 16 the reinforcing steel cage (13) is supported by hook bolts (12) projecting from a concrete lining (10) by extending the concrete lining jack (8).

Figure 17:
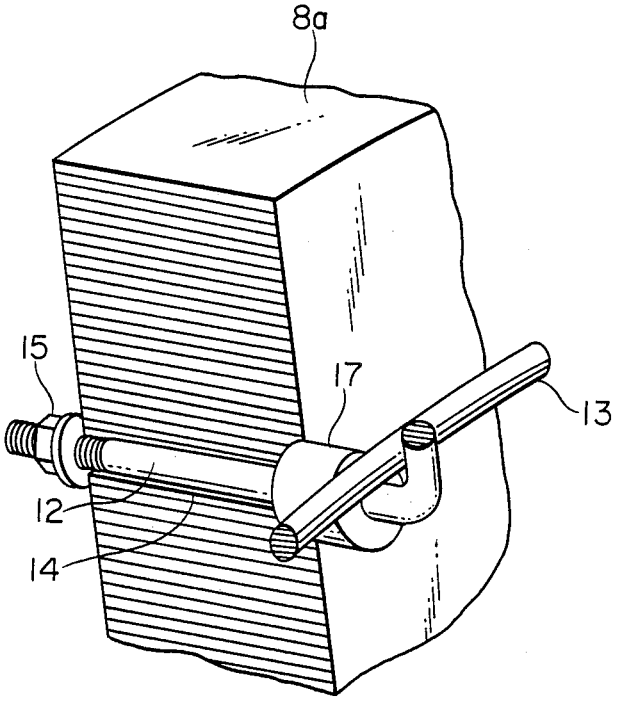
FIGS. 17 and 18 are perspective views respectively showing a mount portion of a reinforcing steel cage to a concrete lining jack.

FIG. 17 shows details of the mount portion of the reinforcing steel cage (13) to the hook bolts (12), a combined spacer and packing (17) is fitted around each hook bolt (12), and thereby leakage of cement paste can be prevented.

Figure 18:
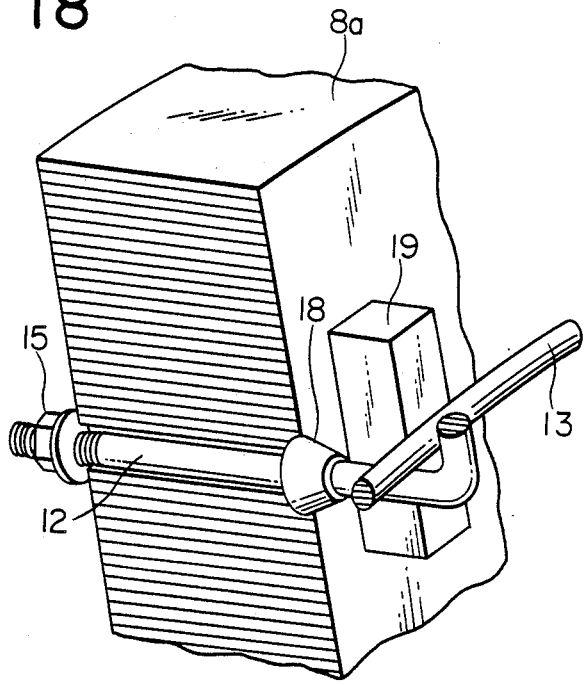

FIG. 18 shows another example of the mount portion in which a packing (18) is fitted around the hook bolt (12) and a spacer (19) is interposed between the combined spreader and end form (8*a*) and the reinforcing steel cage (13).

Figure 19:
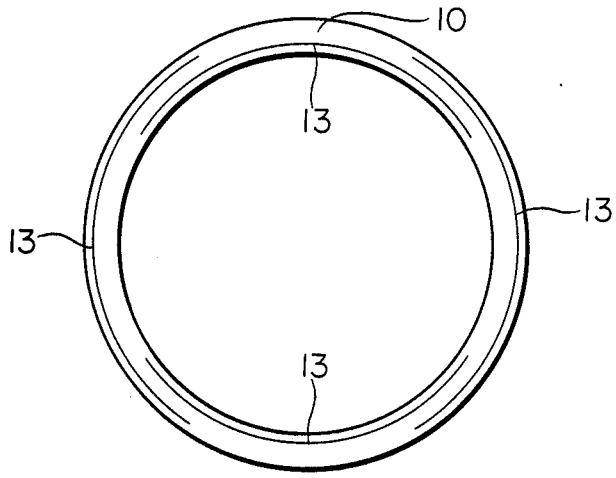
FIG. 19 is a transverse cross-section front view showing a state of arrangement of isolated reinforcing steels.

FIG. 19 shows the state of arrangement of reinforcing steel cages (13) each consisting of a single reinforcing bar as arranged so as to conform to the state of stresses in a transverse cross-section. More particularly, in the top and bottom portions of a main tunnel body tensile stresses would occur in an inside portion of a transverse cross-section of the concrete lining (10), whereas in the left and right portions of the main tunnel body tensile stresses would occur in an outside portion of the transverse cross-section, and therefore, the reinforcing bars are arranged so as to effectively reinforce the concrete lining against the respective stresses.

FIGS. 20 to 25 illustrate another preferred embodiment of the present invention, in which a shield shell 1 includes a front shield drum (1A) and a rear shield drum (1B), and component parts equivalent to those of the above-described first preferred embodiment are given like reference numerals.

Figure 20:
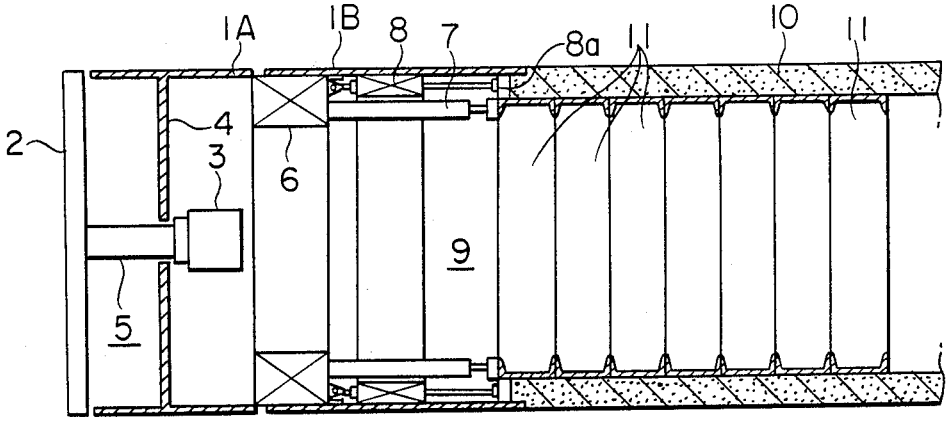
FIGS. 20 through 25 are longitudinal cross-section side views showing successive steps in a method for constructing a tunnel according to another preferred embodiment of the present invention.
Figure 21:
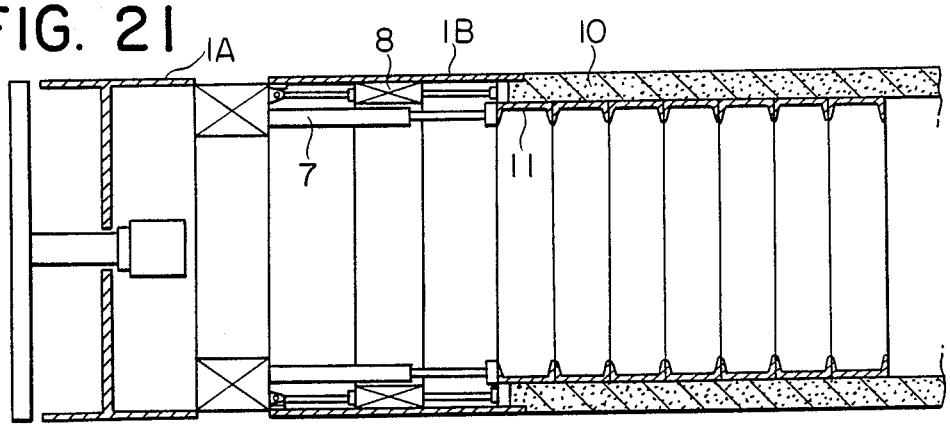

FIG. 20 shows the state where shoving of the shield tunnelling machine has been completed, and starting from this state a shield jack (7) is extended with a reaction force received by an inner form (11) to make the front shield drum (1A) advance resulting in the state shown in FIG. 21. During this period, a concrete lining jack (8) extend in synchronism with the shield jack (7) and thereby holds a predetermined compressing force to a concrete lining (10).

Figure 22:
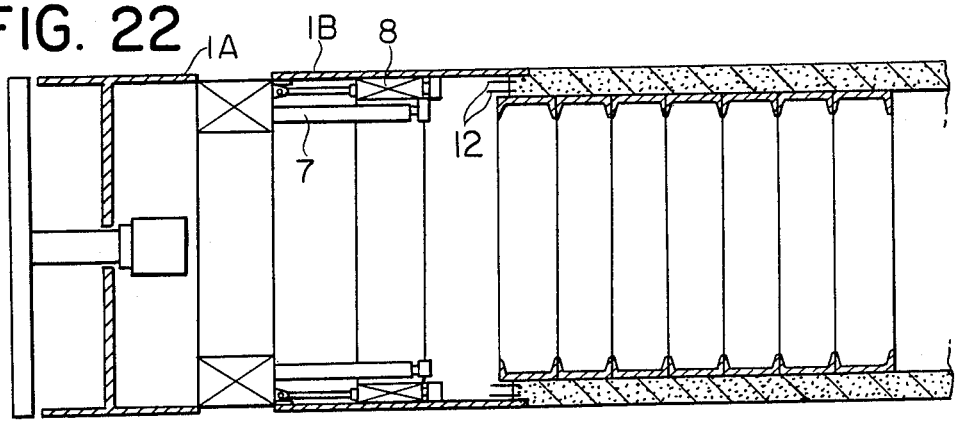
Figure 23:
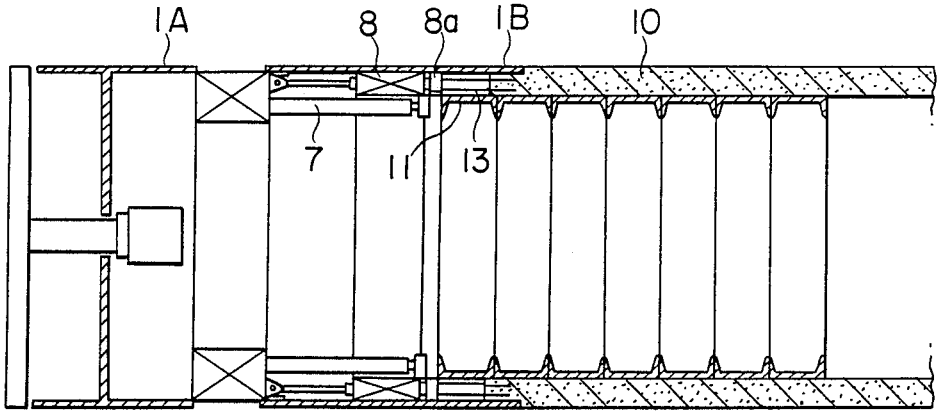

Subsequently, the respective jacks (7) and (8) are retracted, and the hook bolts (12) take the state of projecting from the reinforcing steel cage (13) within the concrete lining (10) into the space in front of the concrete surface of the concrete lining (10) (See FIG. 22).

Figure 24:
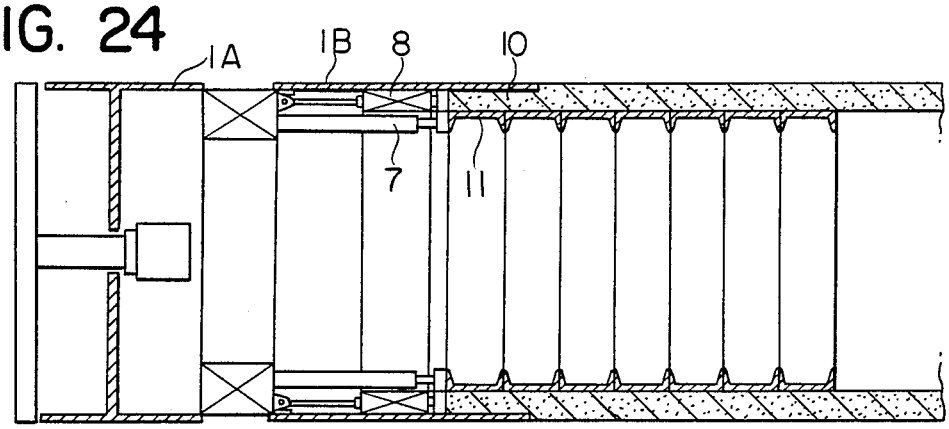

Then, a reinforcing steel cage (13) is mounted to a combined spreader and end form (8*a*) of the concrete lining jack (8) via hook bolts (12) and an additional inner form (11) is assembled (See FIG. 23), and further, as shown in FIG. 24, concrete for lining (10) is placed.

Figure 25:
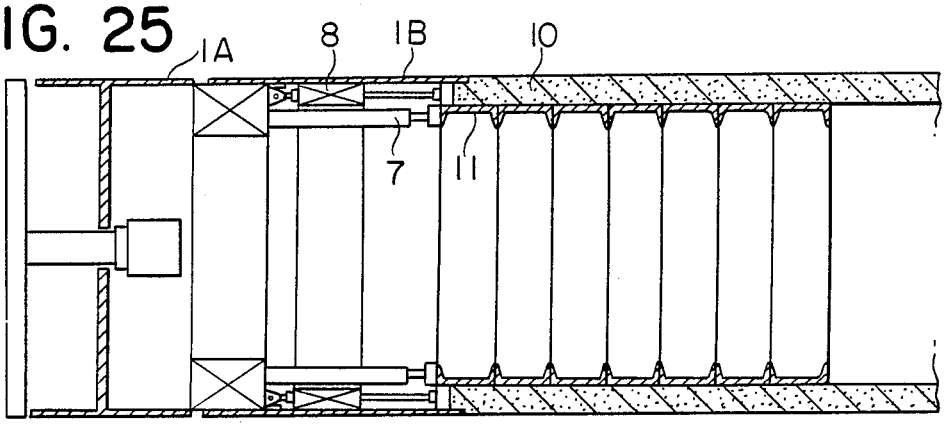

Thereafter, as shown in FIG. 25, while the concrete for lining (10) is being compressed by the concrete lining jack (8), the rear shield drum (1B) is shoved by the reaction force of the concrete lining jack (8), and thus shoving of the tunnelling machine is completed, resulting in the state shown in FIG. 20.

Subsequently, by repeating the same steps as those described above, the reinforcing steel cage is buried in the concrete lining.

According to the present invention, in a shield tunnelling method of field placed concrete lining type, a main tunnel body can be constructed as a reinforced concrete structure that is structurally reliable as described above, and in this method since it is only necessary to mount a preliminarily assembled reinforcing steel cage to a combined spreader and end form of a concrete lining jack via mount metals, the work of disposing a reinforcing steel cage can be achieved easily even in a narrow space within a shield tail, and if the working space is yet insufficient, it is only necessary to retract the concrete lining jack by a desired length.

Furthermore, upon disposing the reinforcing steel cage within the concrete for lining, the reinforcing steel cage can be disposed at a predetermined position in the axial direction of the tunnel by adjusting the stroke of the concrete lining jack.

Still further, since the reinforcing steel cage can be assembled independently of the inner form as guided by the combined spreader and end form of the concrete lining jack within the shield tail, the form of the reinforcing steel cage is restricted by the method of assembling the inner form.

While a principle of the present invention has been described above in connection to preferred embodiments of the invention, it is a matter of course that many apparently widely different embodiments thereof can be made without departing from the spirit of the present invention.

What is claimed is:

1. A method of constructing a reinforced concrete tunnel, said method comprising the steps of:

(a) advancing a shield tunneling machine of the type having a concrete lining jack in a tunnel in the ground;

(b) attaching reinforcing bar means to the concrete lining jack;

(c) filling concrete around the reinforcing bar means; and (d) extending the concrete lining jack opposite of the advancing direction of the shield tunneling machine for simultaneously compressing the concrete and moving the reinforcing bar means into position.

2. A method as in claim 1, wherein step (d) includes the preliminary substep of adjusting the length of extension stroke of the concrete lining jack for moving the reinforcing bar means a predetermined distance into position.

3. A method of constructing a reinforced concrete tunnel, said method comprising the steps of:

(a) locating a shield tunneling machine of the type having an outer shield, a concrete lining jack, and a shield jack in a tunnel in the ground;

(b) placing an inner form and a concrete lining rearwardly of the shield tunneling machine in the tunnel;

(c) extending the concrete lining jack and the shield jack for contacting the already placed concrete lining and the already placed inner form respectively for advancing the shield tunneling machine;

(d) retracting the concrete jack and the shield jack for defining a space between the already placed inner form and already placed concrete lining and the concrete jack and shield jack;

(e) attaching reinforcing bar means to the concrete jack in the space defined in step (d);

(f) filling the space defined in step (d) with concrete;

(g) extending the concrete jack a predetermined distance in a direction for reducing the volume of the space defined in step (d) for moving the attached reinforcing bar means a predetermined distance to a predetermined location and for compressing the concrete.

4. A method as in claim 3, wherein step (e) includes the preliminary substep of attaching hook bolts to the concrete jack for attaching reinforcing bar means thereto.

5. A method as in claim 4, wherein step (e) includes the final substep of placing an inner form adjacent and forwardly of the already placed inner form for further defining the space defined in step (d).

* * * * *